US009421506B2

(12) United States Patent
Janz

(10) Patent No.: US 9,421,506 B2
(45) Date of Patent: Aug. 23, 2016

(54) STATIC MIXER

(71) Applicant: Chemineer, Inc., Dayton, OH (US)

(72) Inventor: Eric Edward Antonio Janz, Clearcreek Township, OH (US)

(73) Assignee: NOV NORTH AMERICA I/P, LLC, Houston, TX (US)

( * ) Notice: Subject to any disclaimer, the term of this patent is extended or adjusted under 35 U.S.C. 154(b) by 525 days.

(21) Appl. No.: 13/918,106

(22) Filed: Jun. 14, 2013

(65) Prior Publication Data

US 2013/0336084 A1 Dec. 19, 2013

Related U.S. Application Data

(60) Provisional application No. 61/660,196, filed on Jun. 15, 2012.

(51) Int. Cl.

| | |
|---|---|
| ***B01F 5/06*** | (2006.01) |
| ***B01F 5/04*** | (2006.01) |
| ***B01F 3/08*** | (2006.01) |
| *B01F 3/10* | (2006.01) |

(52) U.S. Cl.

CPC ..... *B01F 5/0605* (2013.01); *B01F 3/0865* (2013.01); *B01F 5/0473* (2013.01); *B01F 5/0616* (2013.01); *B01F 2003/105* (2013.01); *B01F 2005/0639* (2013.01)

(58) Field of Classification Search

CPC ..... B01F 5/0605
USPC ..... 366/174.1, 175.2, 181.5, 337, 338
See application file for complete search history.

(56) References Cited

U.S. PATENT DOCUMENTS

| | | | | |
|---|---|---|---|---|
| 846,751 | A * | 3/1907 | Melvin | B01F 5/246 193/32 |
| 1,152,381 | A * | 8/1915 | Kenney | F01N 3/04 138/40 |
| 1,186,386 | A * | 6/1916 | Egan | F02M 1/00 48/160 |

(Continued)

FOREIGN PATENT DOCUMENTS

| | | |
|---|---|---|
| CN | 1479752 | 3/2004 |
| CN | 1550256 | 12/2004 |
| WO | 2008/068438 | 6/2008 |

OTHER PUBLICATIONS

CN, First Office Action; Chinese Patent Application No. 201380031346.1 (Sep. 1, 2015).

(Continued)

*Primary Examiner* — David Sorkin
(74) *Attorney, Agent, or Firm* — Thompson Hine LLP

(57) ABSTRACT

A static mixer may include a conduit section having a channel, an injector opening through an inner wall thereof, a tab having a main portion extending from the inner wall adjacent and downstream of the opening and extending radially inwardly at an angle away from the opening in the downstream direction, and having at least one finger extending at a non-zero angle from the main portion, the main portion and the at least one finger being configured such that a second fluid injected through the injector opening and into a first fluid flowing through the conduit section flows radially along the main portion toward a center of the conduit section, and radially outward from the main portion along the at least one finger, whereby the first and second fluids are thoroughly mixed as a result of turbulence imparted by the tab to the fluids.

17 Claims, 6 Drawing Sheets

(56) References Cited

U.S. PATENT DOCUMENTS 1,345,791 A * 7/1920 Livingstone ..... F02M 1/00 138/37
1,678,225 A * 7/1928 Kincade ..... B01F 5/0415 196/46
1,689,446 A * 10/1928 Miller et al. ..... F02M 1/00 138/37
3,297,305 A * 1/1967 Walden ..... B01F 5/0451 169/15
3,664,638 A * 5/1972 Grout et al. ..... F28F 13/12 138/42
4,072,296 A * 2/1978 Doom ..... B01F 5/0619 366/337
5,839,828 A 11/1998 Glanville
6,536,420 B1 * 3/2003 Cheng ..... B01F 5/0616 123/590
6,951,908 B2 10/2005 Groos et al.
7,316,503 B2 1/2008 Mathys et al.
7,797,937 B2 * 9/2010 Endicott ..... F02M 29/06 123/306
2004/0223408 A1 11/2004 Mathys et al.
2008/0267780 A1 * 10/2008 Wirth ..... B01F 3/022 416/204 A
2010/0148382 A1 6/2010 Castaignede et al.
2012/0320708 A1 * 12/2012 Geibel ..... B01F 3/04049 366/337

OTHER PUBLICATIONS

International Search Report and Written Opinion, International Application No. PCT/US2013/045770 (Sep. 25, 2013).

* cited by examiner

STATIC MIXER

FIELD

The present disclosure relates to static mixers for use in conduits, and more particularly, to static mixers for mixing an injected fluid with a fluid flowing in the conduit.

BACKGROUND

Static mixers may be used to mix low viscosity fluid or fluids flowing in a pipe or conduit. Static mixers typically include an arrangement of fixed vanes or other elements that are mounted in a section of the conduit and arranged to impart turbulence to a fluid flowing in the conduit as the fluid flows around the vanes or other elements. Some static mixer designs may be relatively energy efficient in that they may impart the required amount of turbulence to fluid flow with a relatively small pressure drop in fluid flowing through the mixing elements. However, a disadvantage with such static mixers is that they may have long mixing lengths—they may require a significant amount of conduit length to effect a desired amount of mixing.

Other static mixer designs may provide "length efficient" mixing. This means that the static mixer effects a desired amount of mixing at a relatively short distance downstream of the static mixer. However, such static mixers may possess a disadvantage in that they may use more energy to effect the desired amount of mixing, which results in a higher pressure drop in the fluid flowing across the mixer. Accordingly, there is a need for a static mixer that provides thorough mixing of the fluids in the conduit in which it is mounted in a relatively short distance and at a pressure drop that may be relatively small compared to static mixers of comparable size and mixing effect.

Static mixers may be used to mix fluids having different physical properties, such as different viscosities. Such differences in physical properties may require the use of static mixers that are relatively long in comparison to the diameter of the conduit in which they are mounted, or which may require relatively long mixing distances. In some applications, it may be necessary to use multiple static mixer elements, arranged serially in a conduit. Accordingly, there is a need for a static mixer that is capable of mixing fluids having different physical properties, but is of a relatively short length, does not require a significant mixing distance downstream of the mixing element, and which can affect the desired amount of mixing with a single mixer element.

SUMMARY

In one embodiment, the disclosed static mixer may include a conduit section having a channel and an injector opening through an inner wall thereof, a tab having a main portion extending from the inner wall adjacent and downstream of the opening and extending radially inwardly and at an angle away from the opening in the downstream direction, and having at least one finger extending at a non-zero angle from the main portion, the main portion and the at least one finger being configured such that a second fluid injected through the injector opening and into a first fluid flowing through the conduit section flows radially along the main portion toward a center of the conduit section, and radially outward from the main portion along the at least one finger, whereby the first fluid and the second fluid are thoroughly mixed as a result of turbulence imparted by the tab to the first fluid and the second fluid.

In another embodiment, the disclosed static mixer may include an annular conduit section having a channel and an injector opening through an inner wall thereof, a tab having a main portion attached to and extending from the inner wall adjacent and downstream of the injector opening, and extending radially inwardly and at an angle away from the injector opening, and having a pair of opposing fingers extending from a terminal portion of the main portion, each of the opposing fingers extending at a non-zero angle from the main portion, the main portion having a concave shape extending longitudinally along the main portion and opening toward the injector opening, wherein the injector opening is positioned within a portion of the generally concave shape of the main portion, each of the opposing fingers having a generally concave shape extending longitudinally along the finger facing away from the injector opening, and the main portion and opposing fingers are configured such that a second fluid injected through the injector opening and into a first fluid flowing through the conduit section flows radially along the main portion toward a center of the conduit section, and radially outward from the main portion along each of the opposing fingers, whereby the first fluid and the second fluid are thoroughly mixed as a result of turbulence imparted by the tab to the first fluid and the second fluid.

In yet another embodiment, a method for mixing a first fluid flowing through a conduit with a second fluid is disclosed, the method may include providing a conduit section having an injector opening for injecting the second fluid, providing a tab in the conduit section having a main portion extending from an inner wall of the conduit section and downstream of the opening, and extending radially inwardly and at an angle away from the opening in a direction downstream of the flow of the first fluid, and at least one finger extending from the main portion, the finger having a generally concave shape facing in a downstream direction away from the opening, and causing a second fluid to flow through the injector opening and into flow of the first fluid in the conduit section, whereby the second fluid flows radially along the main portion toward a center of the conduit section, and radially along the at least one finger, and providing a rotating component to the second fluid by passing the second fluid around the at least one finger, whereby the second fluid is distributed over the conduit cross-section.

Other objects and advantages of the disclosed static mixer will be apparent from the following description, the accompanying drawings and the appended claims.

DETAILED DESCRIPTION

Figure 1:
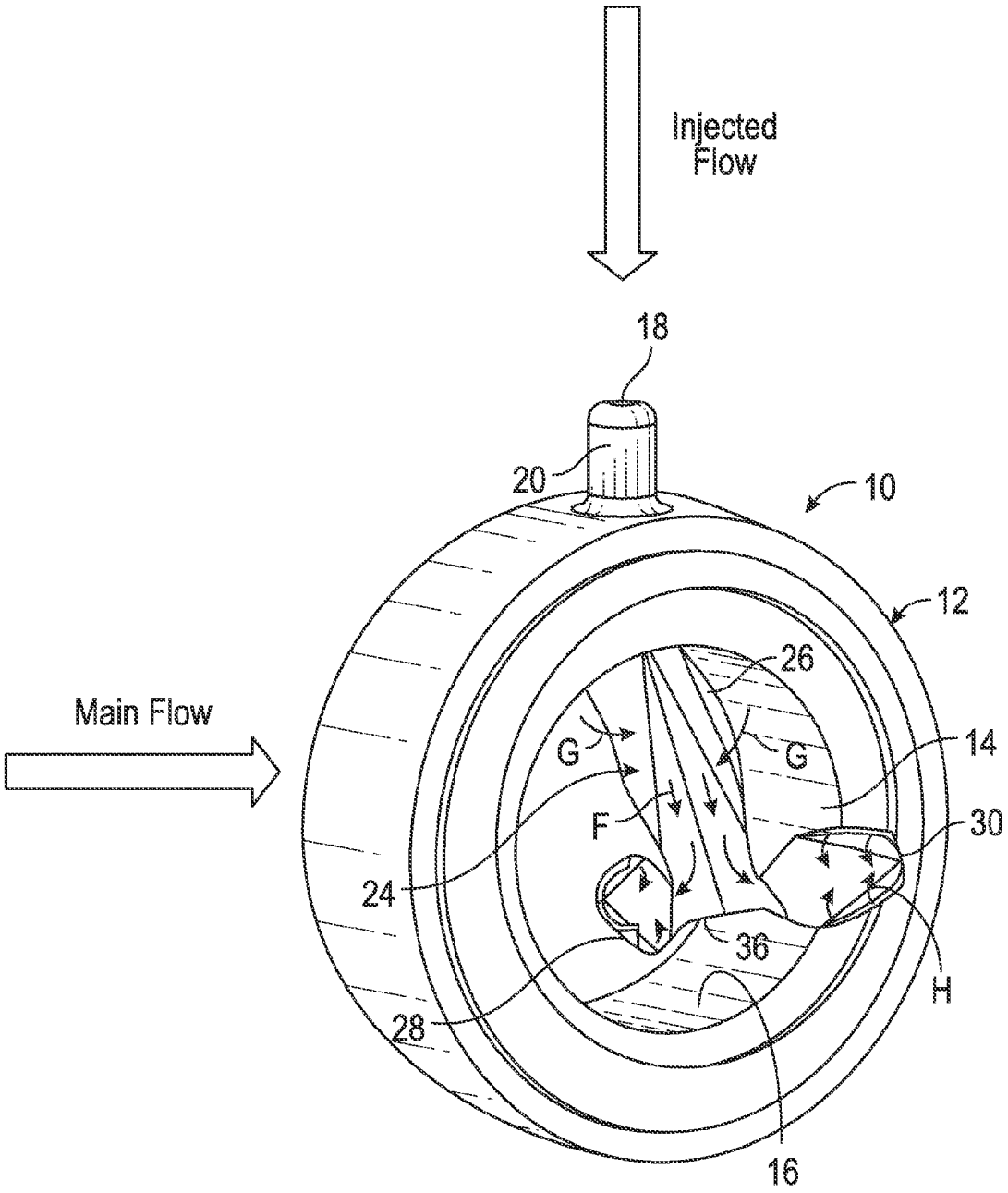
FIG. 1 is a perspective view of an embodiment of the disclosed static mixer, viewed from downstream of the static mixer.

As shown in FIG. 1, an embodiment of the disclosed static mixer, generally designated 10, may include a conduit section 12 that defines a channel 14 and includes an inner wall 16. In an embodiment, the conduit section 12 may be circular in cross section, such that the inner wall 16 may be cylindrical in shape. In other embodiments, the conduit section 12 may be non-circular in cross section, such as oval, elliptical or irregular, or may have a polygonal shape in cross section. The conduit section 12 may include an injector passage 18 (see also FIG. 4) that extends through a raised boss 20 in a generally radial direction and terminates in an injector opening 22 in the inner wall 16. In embodiments, the raised boss 20 may take the form of a pipe nipple (shown), flanged pipe, or other piping attachment. The conduit section 16 may be made of plastic, such as polyvinyl chloride (PVC), or made of metal, such as copper, cast iron or stainless steel, or made of other material suitable for conveying the liquids selected to be mixed.

The static mixer 10 also may include a tab, generally designated 24, that may be attached to the inner wall 16 of the conduit section 12 adjacent the injector opening 22 and extend toward a center of the channel 14. In embodiments, the tab may be made of metal, such as stainless steel or other strong, non-corrosive metals, or of plastic, such as nylon. The tab 24 may be stamped, cast, or molded as a single piece, or built up of components.

The tab 24 may include a main portion 26 extending from the inner wall 16 adjacent and downstream of the opening 22 and extending radially inwardly and at an angle away from the opening in the downstream direction. In an embodiment, the angle may be a non-zero angle relative to a diameter of the conduit section 12. The tab 24 also may include at least one finger, and in the embodiment shown the at least one finger may take the form of a pair of opposing fingers 28, 30, extending at a non-zero angle from the main portion. In an embodiment, the main portion 26 of the tab 24 may terminate in the opposing fingers 28, 30.

As shown in FIGS. 2A, 2B, 2C, and 2D, the main portion 26 of the tab 24 may include an upper end 32 having a generally concave shape. The upper end 32 may be attached to the inner wall 16 (see FIGS. 1 and 4). by welding, brazing, adhesives and other suitable means. The concave shape of the upper end 32 may extend from the inner wall 16 at least partially along the main portion 26, and face toward the injector opening 22. In an embodiment, the injector opening 22 may be positioned within a portion of the generally concave shape adjacent the upper end 32, and preferably the injector opening is aligned with a centerline of the main portion 16 relative to a longitudinal direction of the channel 14 (FIG. 1), as shown at A in FIG. 2D.

In an embodiment, the main portion 26 of the tab 24 may include a substantially flat longitudinal central surface 34 that may extend from the upper end 32 and increase in width to a distal end 36. The main portion 26 also may include edge surfaces 38, 40 extending adjacent opposing, diverging edges 42, 44 of the longitudinal central surface 34. In an embodiment, the edge surfaces 38, 40 may be oriented at an angle to the longitudinal central surface 34 to form the concave shape, and/or in other embodiments, the edge surfaces may be arcuate in shape. In the embodiment shown in FIGS. 2A-2D, the edge surfaces 38, 40 form the concave shape of the upper end 32. In other embodiments, the tab 24 may include a main portion 26 that is configured to have a concave shape by continuously bending the main portion along a longitudinal centerline of the main portion.

As shown in FIGS. 2A-2D, the fingers 28, 30 may have a generally concave shape extending longitudinally along the fingers, facing away from the injector opening 22 (FIG. 4); that is, in a downstream direction. In an embodiment, the fingers 28, 30 extend outwardly from a terminal end 36 of the main portion 26. In an embodiment, the fingers 28, 30 may be oriented such that they are bent in a downstream direction from a plane containing the main portion 26, more specifically the substantially flat longitudinal central surface 34 of the main portion.

Figure 2B:
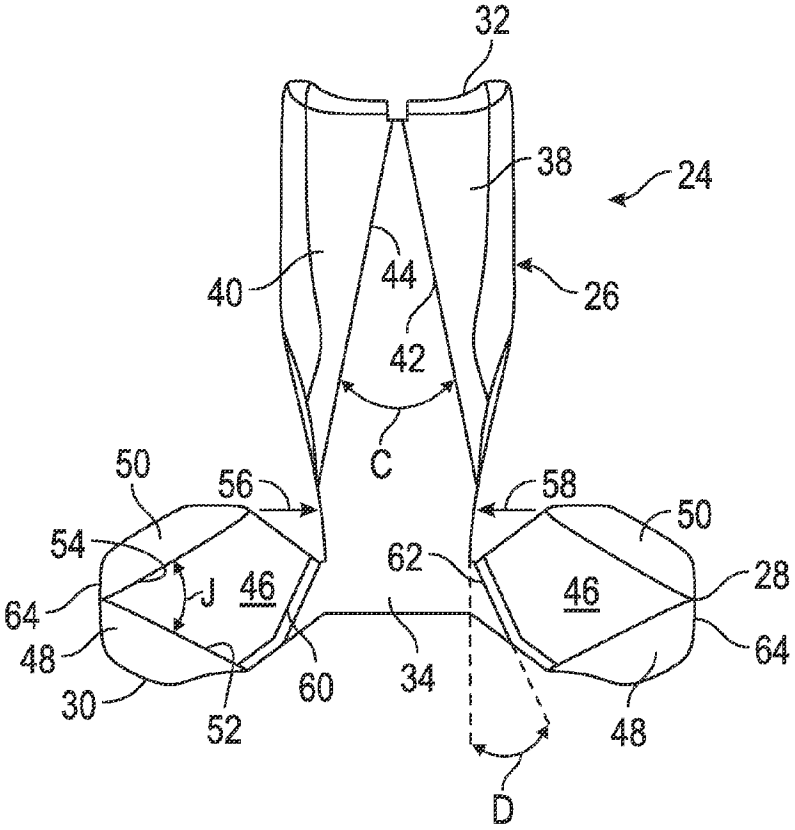
FIGS. 2A, 2B, 2C, and 2D are, respectively, a downstream elevational view, an upstream elevational view, a side elevational view, and a top plan view of the tab of the static mixer of FIG. 1.
Figure 2A:
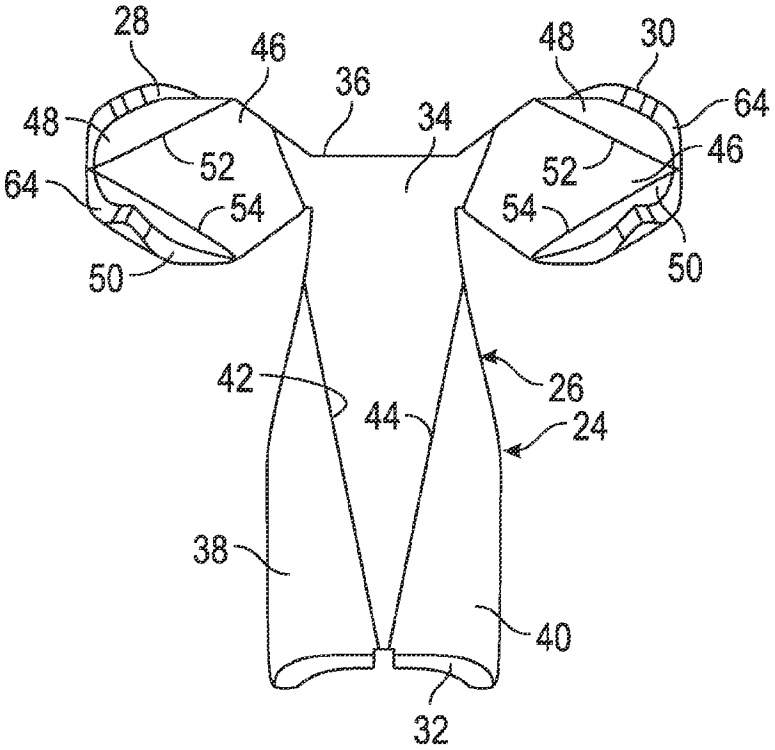
Figure 2D:
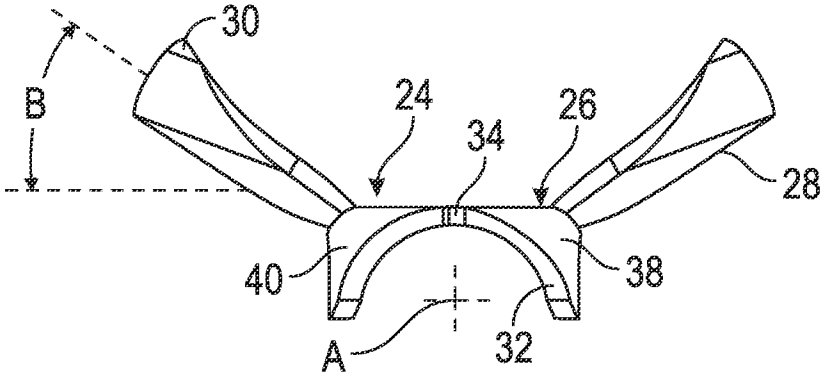
Figure 2C:
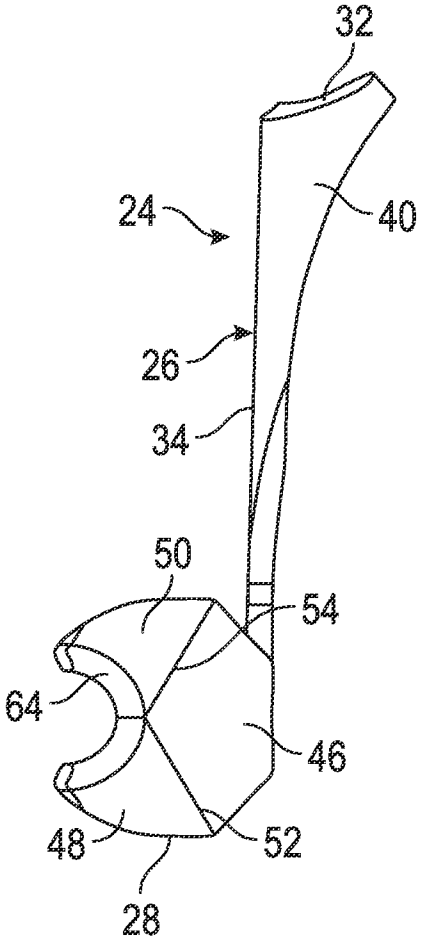
Figure 3:
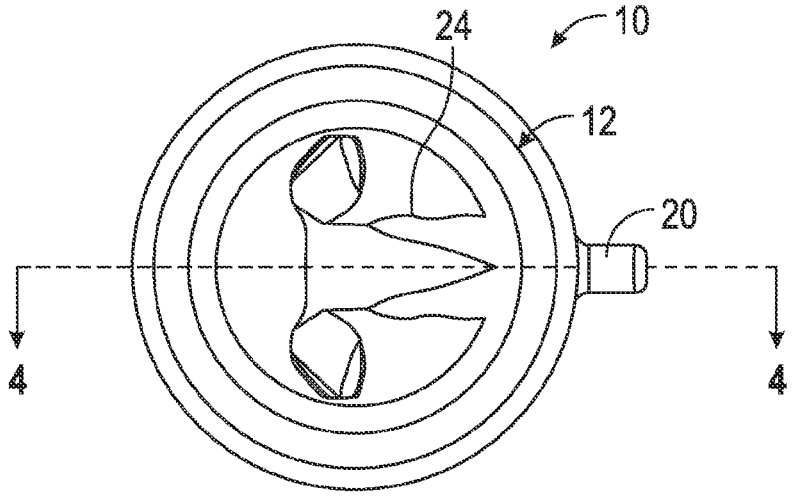
FIG. 3 is a downstream elevational view of the static mixer of FIG. 1.

In an embodiment, the fingers 28, 30 may be similarly shaped, each having a substantially flat central portion 46 and a pair of ears 48, 50 extending along opposing, tapered longitudinal edges 52, 54 of the central portion 46. In an embodiment, the ears 48, 50 may be arcuate in shape, and provide the downstream-facing concave shape to the ears. In an embodiment, as shown in FIG. 2D, the ears 28, 30 may be oriented to extend in a downstream direction from the central surface 34 of the main portion 26 at an angle B of approximately 30°.

In other embodiments, the arcuate shape of the upper end 32 of the main portion 26 may have a radius of approximately 0.155 of the diameter of the interior wall 16 (FIG. 1) of the conduit section 12. The length of the longitudinal central surface 34 may be 0.80 of the diameter of the inner surface 16 of the conduit section 12. As shown in FIG. 2B, the opposing edges 42, 44 may taper at an angle C of approximately 25°. The maximum width of the longitudinal central surface 34, measured at points 56, 58, may be 0.25 of the diameter of the inner wall 16 of the conduit section 12.

The ears 28, 30 may be skewed relative to the longitudinal central surface 34, along lines 60, 62 and angle D of approximately 24°. The radius of the end surfaces 64 may be selected to be 0.055 of the diameter of the inner wall 16 of the conduit section 12. The angle J of the opposing longitudinal edges 52, 54 may be selected to be 57.5°. However, it is within the scope of the disclosure to vary the foregoing angles and ratios to accommodate fluids of a given viscosity and flow rate of through the conduit section 12. In embodiments, the tab 24 may be approximately ⅛ inches thick. The thickness of the tab 24 may be varied to be greater or lesser, depending upon such factors the volume flow rate of the liquids in the conduit, the viscosity of the liquids to be mixed, and presence and size of any particulate material in the liquids.

Figure 5:
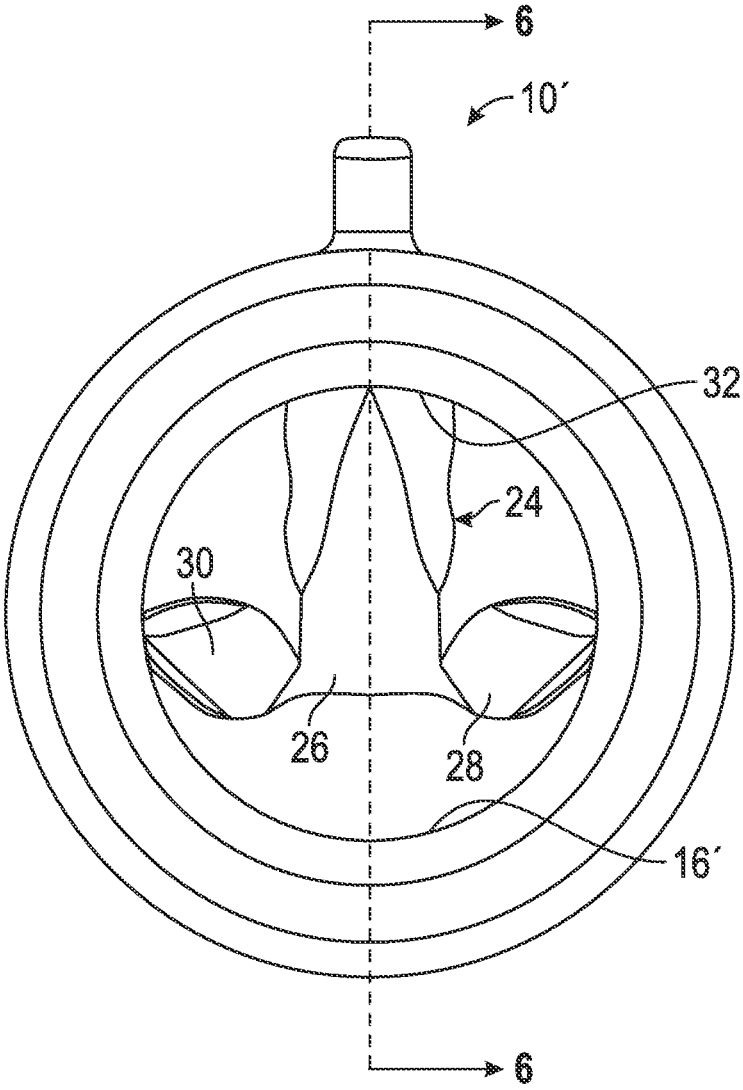
FIG. 5 is a downstream elevational view of another embodiment of the disclosed static mixer.
Figure 6:
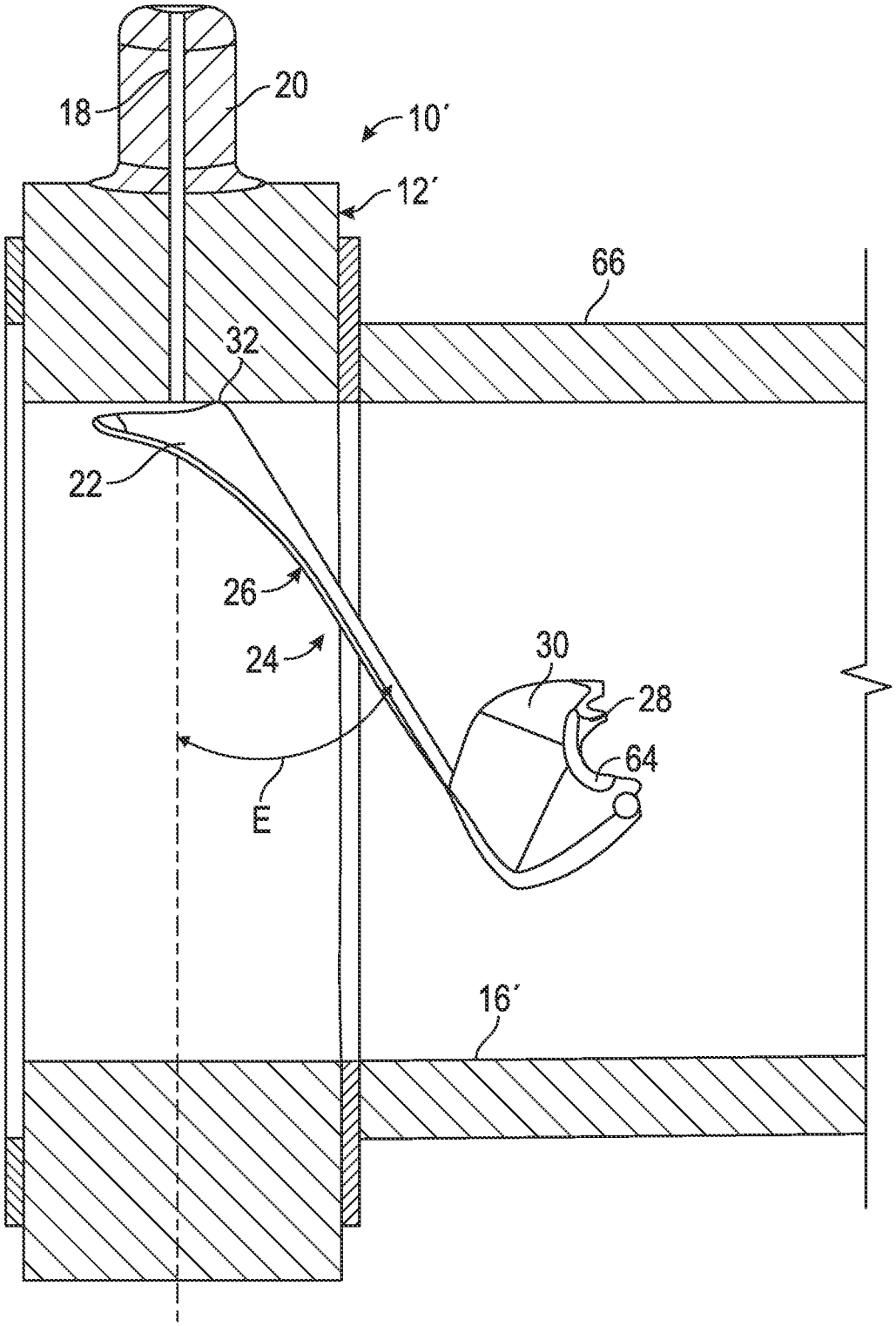
FIG. 6 is a side elevation in section of the static mixer of FIG. 5, taken at line 6-6 of FIG. 5.

As shown in FIGS. 5 and 6, in an alternate embodiment of the static mixer, generally designated 10', the conduit section 12', which in an embodiment may be an annular conduit section, may include a tubular section 66. A terminal portion of the opposing fingers 28, 30, which in an embodiment are the end surfaces 64 of the opposing fingers, may be attached to the inner wall 16' of the extension 66. The attachment may be by adhesives, by brazing or welding, by mechanical connections such as pins or screws, or other attachment mechanisms.

An advantage of attaching the opposing fingers 28, 30 to the interior wall 16' is that the tab 24 may be made of a thinner material since it will be supported at the ends 64 of the fingers 28, 30, as well as at the upper end 32 of the main portion 26. In the embodiment of FIG. 6, the tab 26 may be oriented to extend at a non-zero angle E to a diameter of the conduit cross section, wherein the non-zero angle is approximately 30°.

Figure 4:
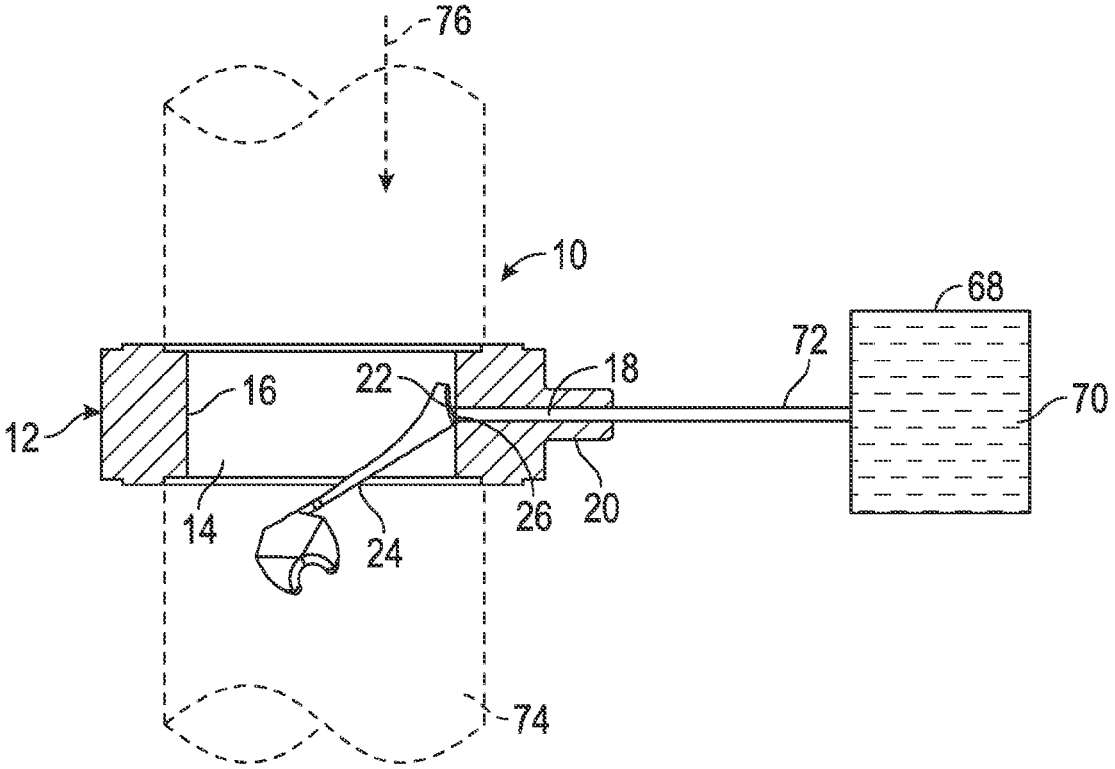
FIG. 4 is a side elevation in section taken at line 4-4 of FIG. 3.

In operation, the static mixer 10, 10' may be connected to a source 68 of a second fluid 70 under pressure by a supply line 72 that is connected to the boss 20, as shown in FIG. 4. In an embodiment, the supply line 72 may include a conventional metering device (not shown) that controls the flow rate of the second fluid 70 through the supply line and into the conduit section 12. In embodiments, the source 68 may retain the second fluid 70 in a pressurized container, and/or include a pump or other device to provide a desired pressure to the second fluid. In still other embodiments, the metering device may provide the requisite pressure to the second fluid 70 in supply line 72.

In the embodiment shown, the conduit section 10 may be incorporated in a conduit 74 in which a first fluid 76 is flowing (see also the "Main Flow" arrow in FIG. 1). The first fluid 76 and second fluid 70 may be of similar or dissimilar viscosities. The second fluid 70 enters the injector passage 18 (see also the "Injected Flow" arrow in FIG. 1) from the supply line 72. As the second fluid 70 leaves the injector opening 22, it flows radially inwardly along the upstream side of the main portion 26 of the tab 24, as indicated by arrows F in FIG. 1. Although constrained by the arcuate edge surfaces 38, 40, some of the fluid flows around the main portion 26, as indicated by arrows G and flows downstream.

The portion of the second fluid 70 (FIG. 4) that travels the entire length of the main portion 26 of the tab 24 will flow from the terminal end 36 of the main portion. Some of the second fluid 70 will flow sidewardly along the upstream side of the fingers 28, 30, and around the arcuate ears 48, 50, as indicated by arrows H in FIG. 1 in a downstream direction. The angle made by the main portion 26 to a diameter may provide optimal mixing of the second fluid 70 with the first fluid across an entire diameter of the conduit in which the conduit section 10, 10' is mounted.

The overall concave shape of the main portion 26 of the tab 24 may impart mechanical strength of the main portion. Further, the concave shape may create a low pressure area behind (i.e., downstream of) the main portion 26 that may distribute the injectant (i.e., the second fluid 70) across the entire cross-section of the conduit section 10, 10'. Consequently, the area of highest energy dissipation may occur prior to or upstream of introduction of the injectant or second fluid 70 into the stream of the first fluid 76.

With the disclosed static mixer 10, 10', placement of the injector opening 22 upstream of the mixer element (the tab 24) the injectant is forced to flow through the high-energy dissipation region created by the mixer element. Having the injectant flow through the high-energy dissipation region may allow for more efficient mixing in terms of both effectiveness for a given mixer length and pressure drop when injecting a second fluid having different physical properties than the first fluid 76 flowing through the conduit 74. Such differences in physical properties of the fluids 70, 76 may include differences in viscosity and in specific gravity.

While the forms of apparatus and methods herein described constitute preferred embodiments of the disclosed static mixer and static mixer operation, it is to be understood that the invention is not limited to these precise forms of apparatus and methods, and that changes may be made therein without departing from the scope of the invention.

What is claimed is:

1. A static mixer comprising:

a conduit section having a channel and an injector opening through an inner wall thereof;

a tab having a main portion extending from the inner wall adjacent and downstream of the opening and extending radially inwardly and at an angle away from the opening in the downstream direction, and having at least one finger extending at a non-zero angle from the main portion; and the main portion and the at least one finger being configured such that a second fluid injected through the injector opening and into a first fluid flowing through the conduit section flows radially along the main portion toward a center of the conduit section, and radially outward from the main portion along the at least one finger, whereby the first fluid and the second fluid are thoroughly mixed as a result of turbulence imparted by the tab to the first fluid and the second fluid.

2. The static mixer of claim 1, wherein the main portion has a generally concave shape extending from the inner wall at least partially along the main portion, and facing toward the injector opening.

3. The static mixer of claim 2, wherein the injector opening is positioned within a portion of the generally concave shape.

4. The static mixer of claim 1, wherein the at least one finger has a generally concave shape extending longitudinally along the at least one finger facing away from the injector opening.

5. The static mixer of claim 1, wherein the conduit section is generally circular in cross section; and the tab is configured to extend at a non-zero angle to a diameter of the conduit section.

6. The static mixer of claim 5, wherein the angle is approximately 30°.

7. The static mixer of claim 1, wherein the at least one finger includes a substantially flat central portion and a pair of ears extending along opposing, tapered longitudinal edges of the central portion, wherein the ears are arcuate in shape to provide a concave shape to the at least one finger facing away from the injector opening.

8. The static mixer of claim 1, further comprising a source of the second fluid under pressure, wherein the injector port is connected to the source of the second fluid under pressure.

9. The static mixer of claim 1, wherein the main portion terminates in the at least one finger.

10. The static mixer of claim 1, wherein the at least one finger includes a pair of opposing fingers.

11. The static mixer of claim 1, wherein the main portion includes a substantially flat longitudinal central surface.

12. The static mixer of claim 11, wherein the main portion includes edge surfaces adjacent opposing edges of the longitudinal central surface, the edge surfaces oriented at an angle to the longitudinal central surface to form the concave shape.

13. The static mixer of claim 12, wherein the edge surfaces are arcuate in shape.

14. The static mixer of claim 1, wherein the main portion is configured to have a concave shape by continuously bending the main portion.

15. The static mixer of claim 1, wherein the at least one finger is bent in a downstream direction from a plane containing the main portion.

16. The static mixer of claim 1, wherein the at least one finger is attached at a terminal portion thereof to the inner wall.

17. A static mixer comprising:

an annular conduit section having a channel and an injector opening through an inner wall thereof;

a tab having a main portion attached to and extending from the inner wall adjacent and downstream of the injector opening, and extending radially inwardly and at an angle away from the injector opening, and having a pair of opposing fingers extending from a terminal portion of the main portion, each of the opposing fingers extending at a non-zero angle from the main portion;

the main portion having a concave shape extending longitudinally along the main portion and opening toward the injector opening, wherein the injector opening is positioned within a portion of the generally concave shape of the main portion;

each of the opposing fingers having a generally concave shape extending longitudinally along the finger facing away from the injector opening; and the main portion and opposing fingers are configured such that a second fluid injected through the injector opening and into a first fluid flowing through the conduit section flows radially along the main portion toward a center of the conduit section, and radially outward from the main portion along each of the opposing fingers, whereby the first fluid and the second fluid are thoroughly mixed as a result of turbulence imparted by the tab to the first fluid and the second fluid.

* * * * *